US008015658B2

(12) United States Patent
Tan

(10) Patent No.: US 8,015,658 B2
(45) Date of Patent: Sep. 13, 2011

(54) HOVER VACUUM CLEANER

(75) Inventor: Michael Tan, Johor (MY)

(73) Assignee: Myvac Technology (M) Sdn. Bhd. (MY)

( * ) Notice: Subject to any disclaimer, the term of this patent is extended or adjusted under 35 U.S.C. 154(b) by 0 days.

(21) Appl. No.: 12/617,722

(22) Filed: Nov. 12, 2009

(65) Prior Publication Data

US 2010/0218337 A1 Sep. 2, 2010

Related U.S. Application Data

(63) Continuation-in-part of application No. 11/550,090, filed on Oct. 17, 2006, now abandoned.

(51) Int. Cl.
*A47L 9/00* (2006.01)

(52) U.S. Cl. ..... 15/327.3

(58) Field of Classification Search ..... 15/327.3, 15/413; *A47L 9/00*
See application file for complete search history.

(56) References Cited

U.S. PATENT DOCUMENTS

| | | | |
|---|---|---|---|
| 2,751,038 | A | 6/1954 | Acheson |
| 5,392,492 | A | 2/1995 | Fassauer |
| 5,483,788 | A | 1/1996 | Fassauer |
| 6,209,167 | B1 | 4/2001 | Rooney et al. |

FOREIGN PATENT DOCUMENTS

| | | |
|---|---|---|
| CA | 2247721 | 3/2000 |
| CA | 2301400 | 9/2001 |
| JP | 06133900 | 5/1994 |
| KR | 200184980 | 7/2000 |

*Primary Examiner* — David Redding
(74) *Attorney, Agent, or Firm* — Dicke, Billig & Czaja, PLLC

(57) ABSTRACT

A self-propulsion hovering vacuum cleaner for domestic or industrial application has air outlets predisposed symmetrically along the longitudinal axis of the underside of the casing for directing more air to the front and back directions of the vacuum cleaner to achieve even distribution of air underneath the vacuum cleaner, thereby reducing juddering or rocking effects. The underside of the casing has a curved surface predisposed symmetrically along the longitudinal axis of the underside of the casing for better retention of air to enhance the hovering effect. In another embodiment of the present invention, air distribution channels are predisposed symmetrically on both sides of the underside of the casing along the longitudinal axis. The air distribution channels are in communication with the air outlets for directing more air to the front and back of the vacuum cleaner. The improved hovering vacuum machine also has self-propulsion features and self-cooling features.

18 Claims, 15 Drawing Sheets

HOVER VACUUM CLEANER

REFERENCE TO RELATED APPLICATION

This application is a continuation-in-part of U.S. application Ser. No. 11/550,090, filed Oct. 17, 2006, now abandoned and claims priority under 35 U.S.C. §119(a) on Patent Application No. PI 20054860 filed in Malaysia on Oct. 17, 2005, the entire contents of which are hereby incorporated by reference.

FIELD OF THE INVENTION

This invention relates to an improved vacuum cleaner and more specifically a self-propulsion hovering vacuum cleaner generally used for domestic or industrial application.

BACKGROUND OF THE INVENTION

Hovering vacuum cleaners are available in the market. Patents for hovering vacuum cleaners include U.S. Pat. No. 2,751,038 issued to L. K. Acheson, Korean Patent No. KR184980Y issued to Bae Suk Wan, Canadian Patent No. 2,247,721 and Canadian Patent No. 2,301,400 issued to Michael Rooney.

Although the vacuum cleaners have hovering features, but they nevertheless require improvement to reduce juddering or rocking due to unequal distribution of air underneath the vacuum cleaners. Furthermore, these prior art vacuum cleaners do not have self-propelling and self-cooling features as contemplated by this invention.

SUMMARY OF THE INVENTION

The present invention provides a hovering vacuum cleaner comprising a casing enclosing a filter chamber and a exhaust chamber, a suction inlet, a filter in the filter chamber, an impeller and a motor for driving the impeller, air outlets predisposed symmetrically at both sides of the underside of the casing, a pathway for air to flow from the inlet through the dust filter, the impeller, the motor and emit through the air outlet, a skirting disposed along the perimeter of the underside of the casing to entrap air emitted through the air outlet and to create a cushion of air at the bottom of the casing to have a hovering effect, and the underside of the casing has a curve up surface predisposed symmetrically along the longitudinal axis of the underside of the casing for better retention of air to enhance the hovering effect.

The primary object of the invention is to provide an improved hovering vacuum cleaner specially designed to achieve a more even distribution of air underneath the vacuum cleaner to reduce juddering or rocking effects.

Another object of the invention is to provide an improved hovering vacuum cleaner with self-propulsion features when the vacuum is energized.

A further object of the invention is to provide an improved hovering vacuum cleaner with built in self-cooling features Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The salient features of the present invention described by reference to FIGS. 1-9 below.

Figure 1:
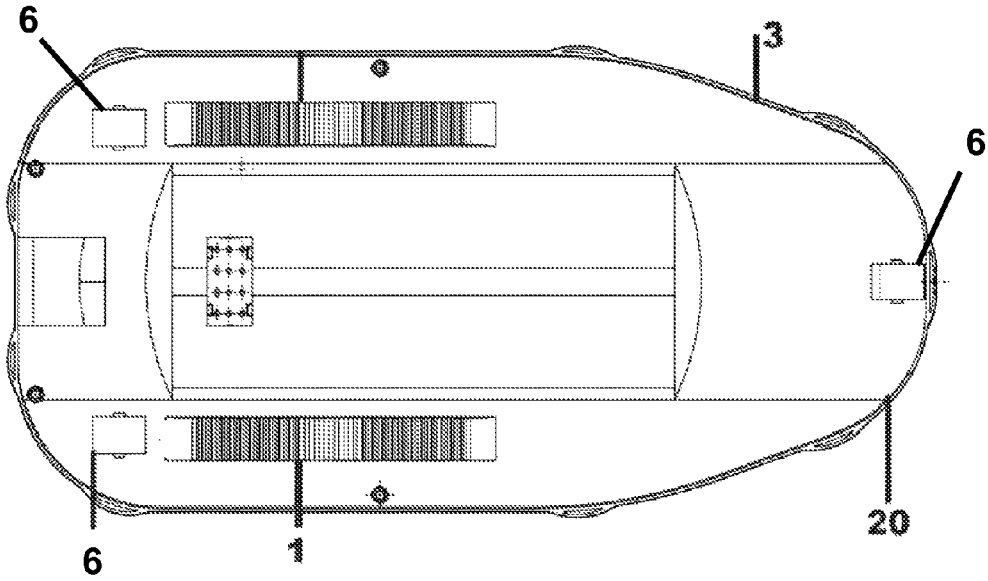
FIG. 1 shows the bottom view of a preferred embodiment of the vacuum cleaner of the present invention.

FIG. 1 shows a self-propulsion hovering vacuum cleaner 100 according to the present invention which encompasses the embodiments of the normal vacuum cleaner via a suction inlet, a casing 20 enclosing a filter chamber, a filter in the filter chamber, a motor chamber, an impelling motor in the motor chamber, a shell-shaped structure enclosing the motor and covering the air outlets 1 which are predisposed symmetrically at both sides of the underside of the casing, a pathway for air to flow from the inlet through the dust filter, the impelling motor and directed by the shell-shaped structure to emit through the air outlet 1, a skirting 3 predisposed along the perimeter of the underside of the casing to entrap air emitted through the air outlet 1 and to create a cushion of air at the bottom of the casing to have a hovering effect. The underside of the casing has a curve up surface predisposed symmetrically along the longitudinal axis of the underside of the casing for better retention of air to enhance the hovering effect.

Figure 2:
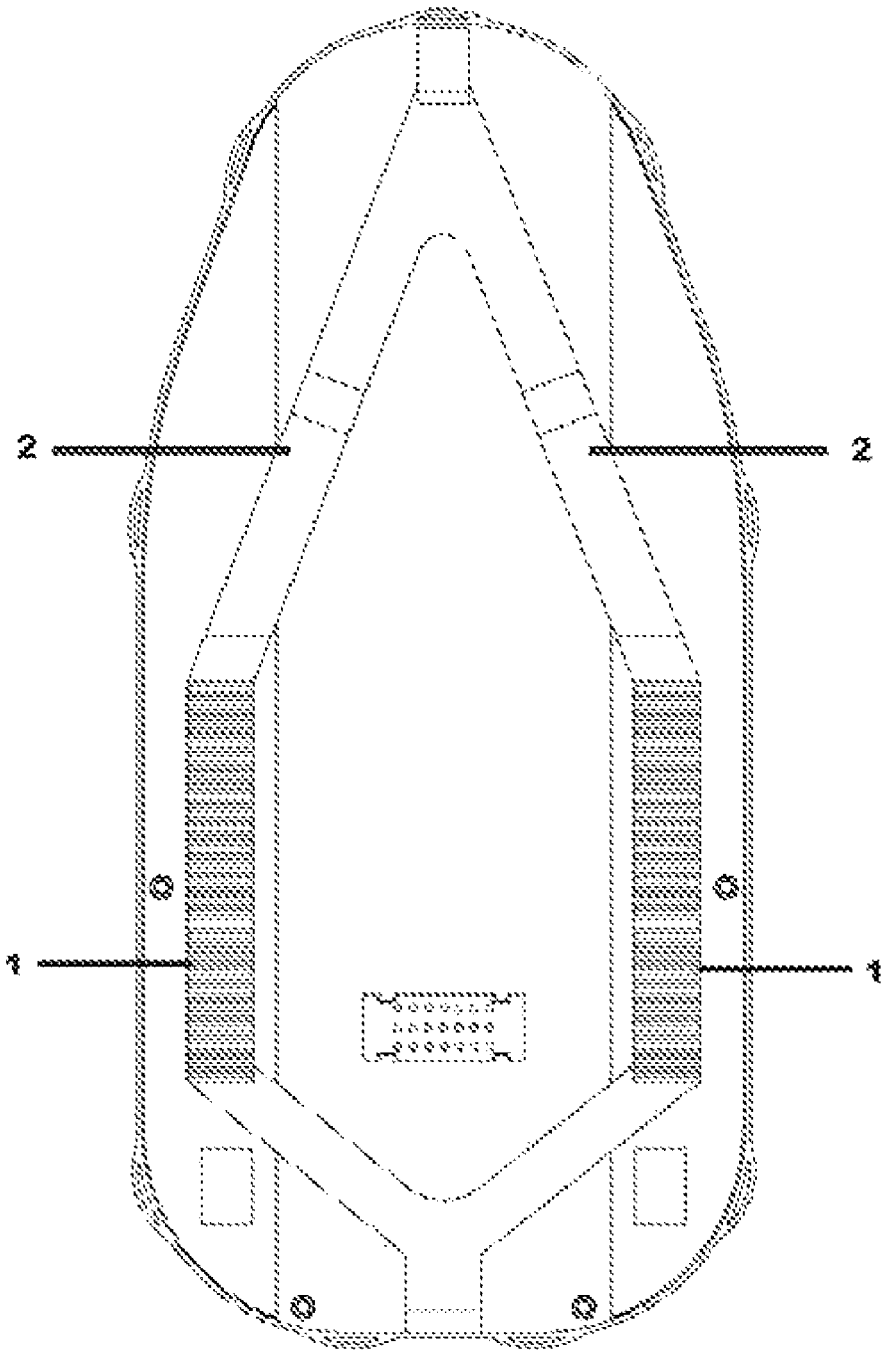
FIG. 2 shows the bottom view of another embodiment of the vacuum cleaner of the present invention.

FIG. 2 shows another embodiment of the present invention the air outlet 1 with the air distribution channels 2 that are in direct communication with the air outlets 1. The suctioned air from the conventional vacuum cleaner 100 is emitted via the air outlet 1 to the air distribution channels 2 that are predisposed symmetrically on both sides of the underside of the casing along the longitudinal axis of the underside of the casing. The air distribution channels 2 are in communication with the air outlets 1 for directing more air to the front and back directions of the vacuum cleaner 100.

To deliver the function properly, the air distribution channels 2 are predisposed symmetrically on both sides of the underside of the casing along the longitudinal axis of the underside of the casing. It is also important that the air distribution channels 2 are in communication with the air outlets 1 for directing more air to the front and back directions of the vacuum cleaner 100.

Figure 3:
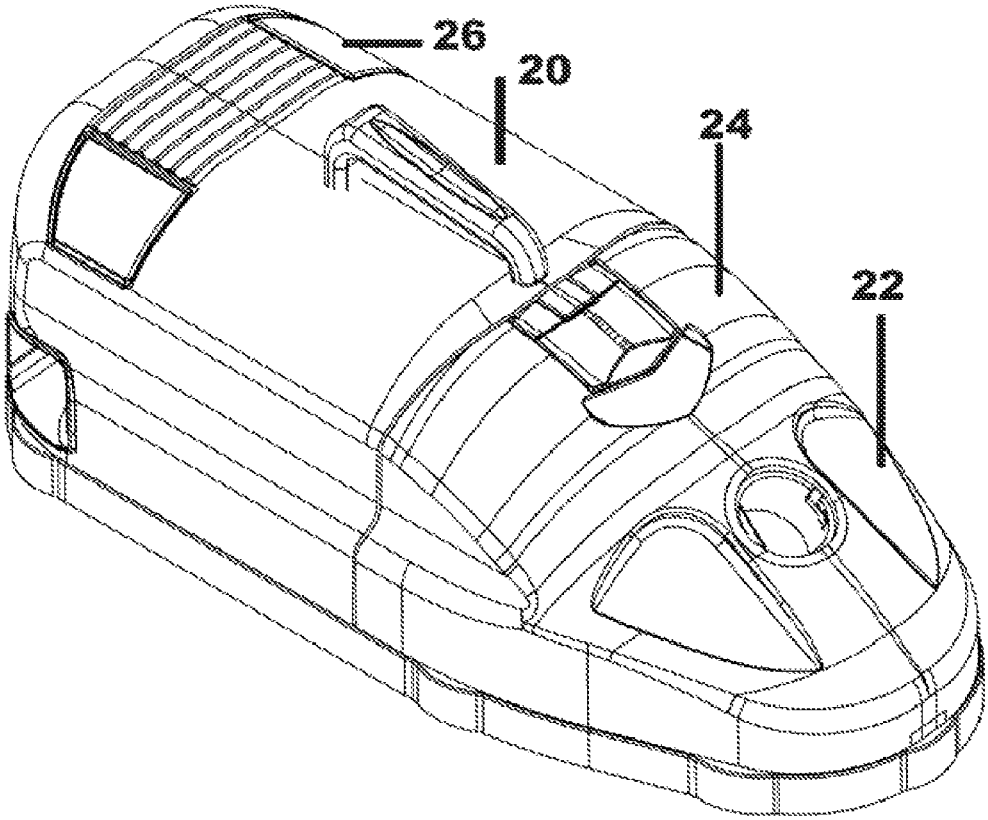
FIG. 3 shows the top view of the vacuum cleaner of the present invention of the present invention.

FIG. 3 shows the top view of the vacuum cleaner 100 of the present invention of the present invention which encompasses a casing 20 enclosing a filter chamber 24 and a motor chamber 26, a suction inlet 22, a filter in the filter chamber 24, an impelling motor in the motor chamber 26, and a shell shaped structure enclosing the impelling motor 26 and covering the air outlets 1. The shell shaped structure directs the air downwards to the air outlets 1 predisposed symmetrically at both sides of the underside of the casing, providing a pathway for air to flow from the inlet 22 through the filter, the impelling motor and to be emitted through the air outlet 1.

Figure 4:
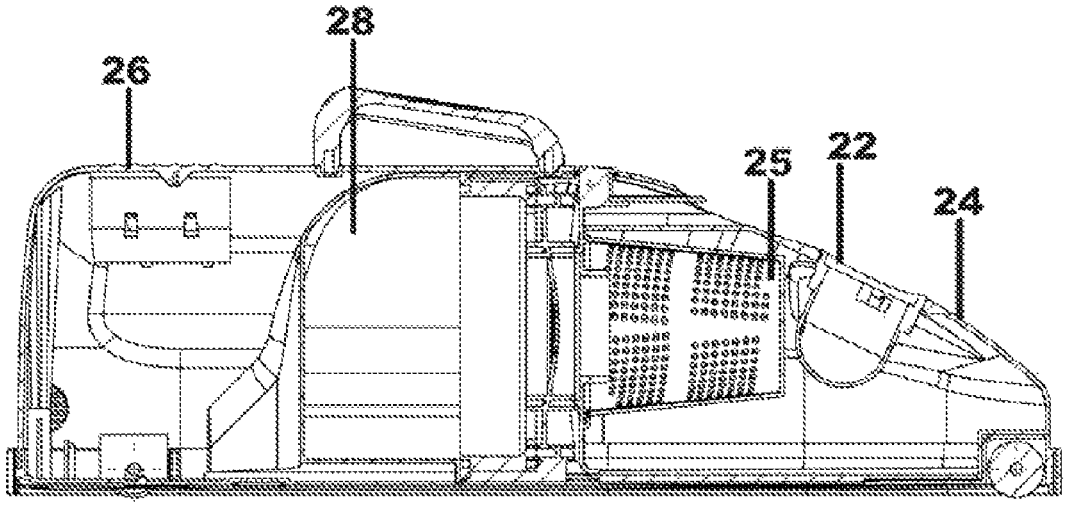
FIG. 4 shows the cross section view of the vacuum cleaner of the present invention.

FIG. 4 shows the cross section view of the vacuum cleaner 100 of the present invention. Air will flow from the suction inlet 22 through the filter 25 in the filter chamber 24 to the impelling motor in the motor chamber 26. The air flow is directed downwards by the shell shaped structure 28 covering the impelling motor to the bottom of the casing and emitted through the air outlet located at the underside of the casing. A skirting predisposed along the perimeter of the underside of the casing entraps air emitted through the air outlets and thereby creates a cushion of air at the bottom of the casing to create a hovering effect.

Figure 5:
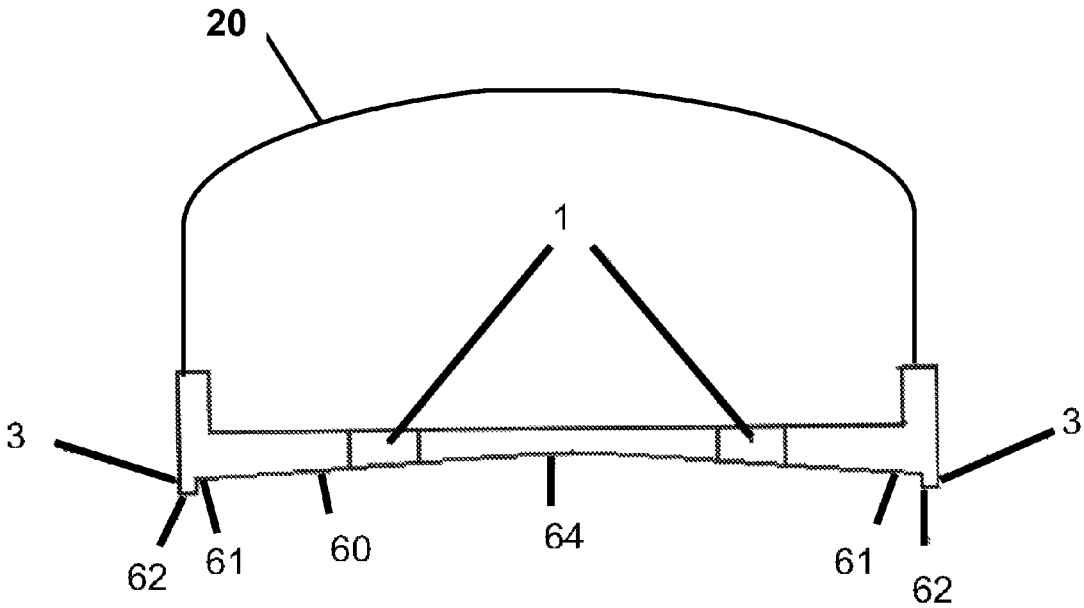
FIG. 5 shows the cross section view of the underside of casing of the present invention.

FIG. 5 shows the cross section view of the underside of casing of the present invention. The skirting 3 functions to trap the air emitted from the air outlets 1 to within the space underneath the vacuum cleaner to create a cushion of air underneath the underside of the casing. The skirting 3 functions to stop the air jet from going outside and to cause air turbulence in the reflected air flow underneath the vacuum cleaner to assist in the hovering effect of the vacuum cleaner. The curve up surface on the underside 60 of the casing is designed to achieve better retention of air to enhance the hovering effect.

As used herein, the term "curve up" means that a portion 61 of the underside 60 that is proximate the skirting 3 is closer to a lower surface 62 of the skirting 3 that a portion 64 of the underside 60 that is distal the skirting 3. The underside 60 can thereby be viewed as having an inwardly and upwardly angled surface that is predisposed symmetrically along a longitudinal axis of the underside 60 of the casing.

Figure 6:
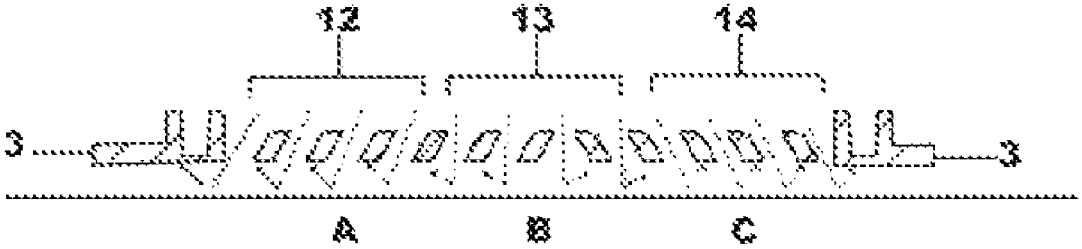
FIG. 6 shows the arrangement of the vanes at the air outlets on the underside of the casing of the present invention.

FIG. 6 shows the arrangement of the vanes 11 at the air outlets on the underside of the casing of the present invention. There are forward directional vanes 12 and backward directional vanes 14 installed at the air outlets at predetermined angles to direct air flow emitted through the air outlets 1 to the front and back directions of the vacuum cleaner and/or to the air distribution channels.

The forward directional vanes 12 are designed to direct the air flow to the forward direction. For the backward direction, the backward directional vane 14 is used. The vanes position will determine the direction of the air flow to achieve a balanced floating effect for the vacuum cleaners.

If more air flow is required in the forward direction then more forward directional vanes 12 covering a larger surface area is used. If more air flow is required in the backward direction then the backward directional vanes 12 covering a larger surface area is used.

Even and balanced distribution of the air flow to the front and back direction of the underside of the casing is important to the hovering actions of the vacuum cleaner, especially to balance its weight and to prevent juddering.

The arrangement of the air outlets 1 that are predisposed symmetrically at both sides of the underside of the casing and the control of air flow through the forward downwards and backward directional vanes 12, 13, 14 play an important role to an even and balanced distribution of the air flow to the front and back direction of the underside of the casing and thereby to balance its center of gravity and to prevent juddering of the vacuum cleaner.

Pointer A shows air flow leaving the air outlets 1 through forward directional vanes 12 at predetermined angles. The high velocity air flow hits and reflects from the ground at predetermined angles and with the skirting 3 to create turbulence air underneath the vacuum cleaner. This turbulent pocket of air creates a floating action at the front portion of the vacuum cleaner.

Pointer B shows air flow leaving the air outlets 1 through downwards directional vanes 13. The high velocity air flow hits and reflects from the ground at 90 degrees and creates turbulent air underneath the vacuum cleaner. This turbulent pocket of air creates a floating action at the central portion of the vacuum cleaner.

Pointer C shows air flow leaving the air outlets 1 through back directional vanes 14 at predetermined angles. The high velocity air flow hits and reflects from the ground at predetermined degrees and with the skirting 3 to create turbulent air underneath the vacuum cleaner. This turbulent pocket of air creates a floating action at the back portion of the vacuum cleaner.

The relative arrangement of the forward, downwards and backward directional vanes 12, 13, 14 causes an even and balanced distribution of the air flow to the front and back direction of the underside of the casing to balance its center of gravity and to prevent juddering of the vacuum cleaner.

In another embodiment of the present invention, the arrangement of the air outlets 1 that are predisposed symmetrically at both sides of the underside of the casing and the control of air flow through the forward and backward directional vanes 12, 14 to the air distribution channels which are predisposed symmetrically on both sides of the underside of the casing along the longitudinal axis of the underside of the casing to achieve an even and balanced distribution of the air flow to the front and back direction of the underside of the casing to balance its center of gravity and to prevent juddering of the vacuum cleaner.

Figure 7:
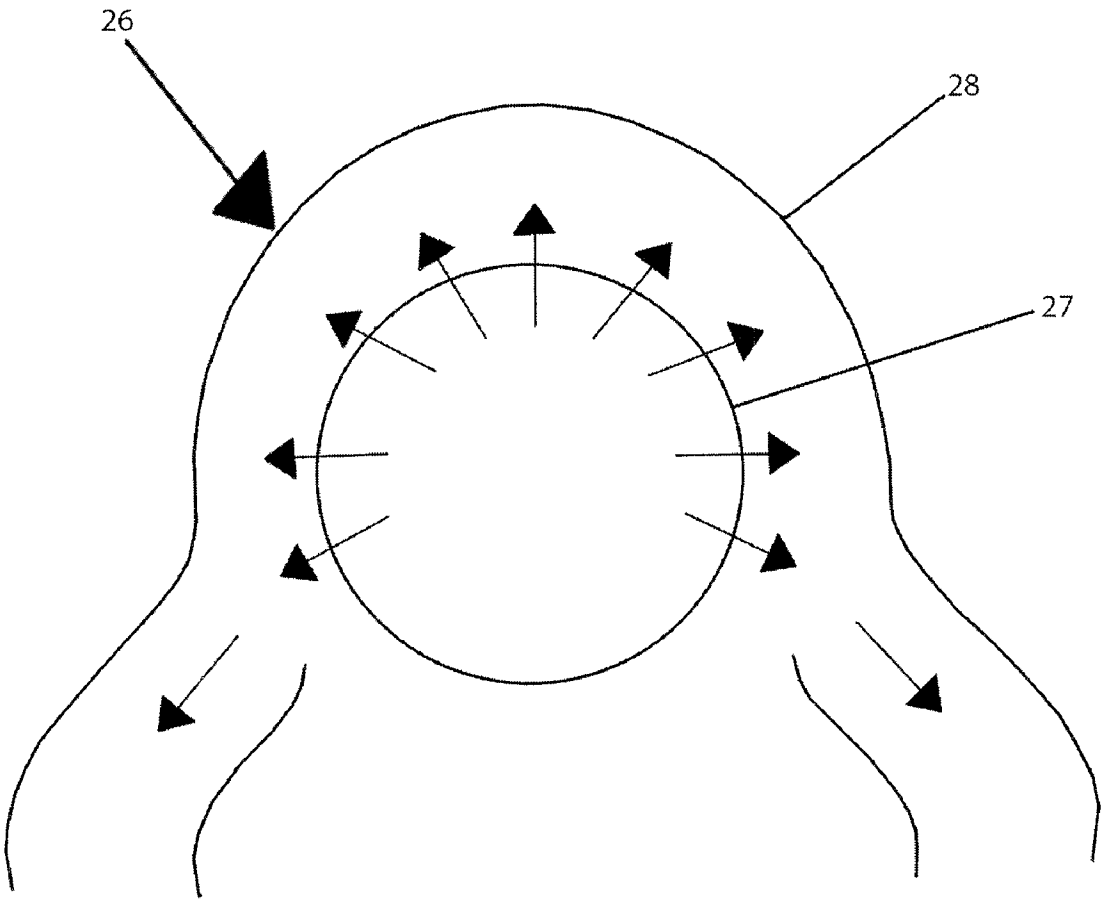
FIG. 7 shows the shell shaped structure covering the impelling motor and the air outlets of the present invention.

FIG. 7 shows the shell shaped structure 28 covering the impelling motor 27 in the motor chamber 26. The shell shaped structure 28 covering the impelling motor 27 and in communication with the air outlets for directing the air flow air flow emitted from the impelling motor 27 to the bottom of the vacuum cleaner through the air outlets. The shell shaped structure 28 shall channel the air flow with little turbulence directly to the bottom of the casing through the air outlets.

Figure 8:
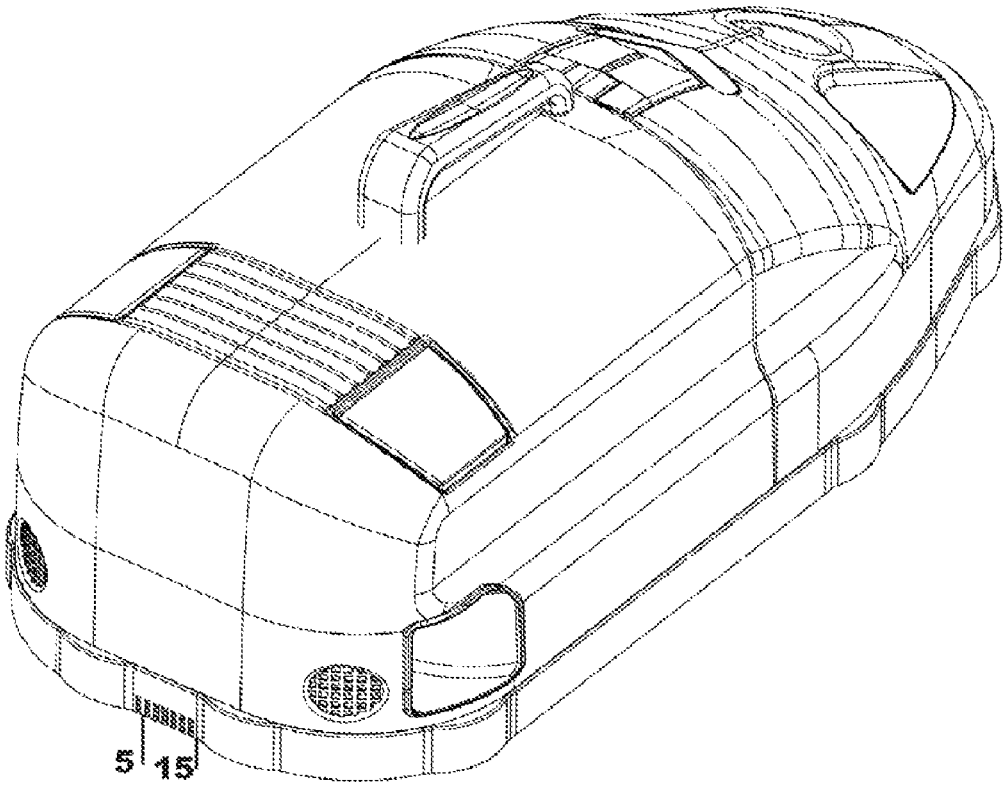
FIG. 8 shows the jet outlet predisposed at the back of vacuum cleaner with lid installed thereon.

FIG. 8 shows jet outlet 5 predisposed at the back of vacuum cleaner 100 with jet outlet lid 15 installed thereon. The jet outlet 5 will enable the entrapped air at the underside of the casing to flow through for self-propelling the vacuum cleaner 100 for ease of maneuvering by the user when the vacuum cleaner 100 is energized. The jet outlet 5 allows the entrapped air to flow through and hence to self-propel the vacuum cleaner 100 forward such that the user only need to guide it to the direction intended.

The jet outlet 5 can be partially or fully closed by a jet outlet lid 15. If the self-propulsion is too strong or if the hovering is required at one spot, then the user can partially or fully close the jet outlet 15 by activating the jet outlet lid 9.

Figure 9:
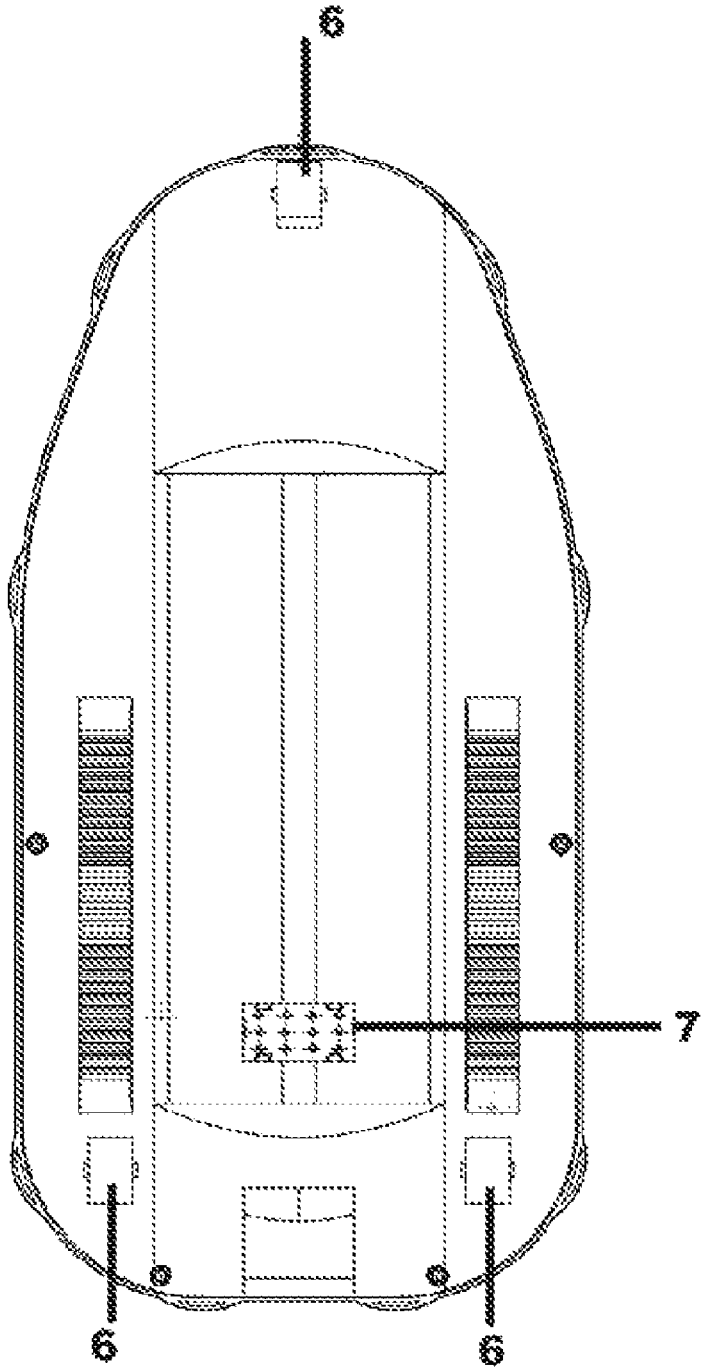
FIG. 9 shows the position of the wheel and air return holes according to one embodiment of the present invention.
Figures 10, 11, 12, 13, 14, 15:
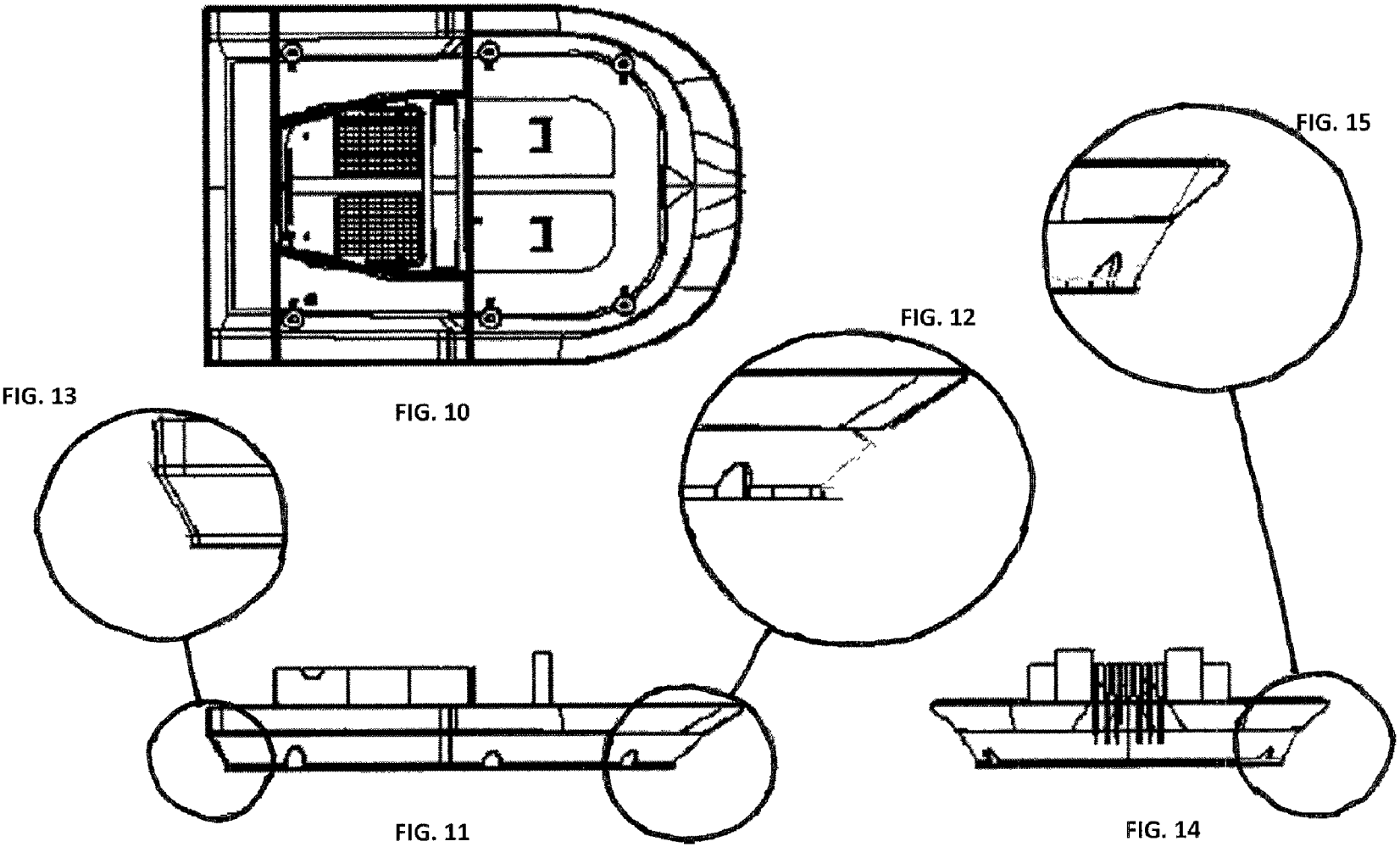
FIG. 10 is an underside view of the vacuum cleaner
FIG. 11 is a side view of a lower portion of the vacuum cleaner.
FIG. 12 is an enlarged view of a front section of the lower portion of the vacuum cleaner.
FIG. 13 is an enlarged view of the back section of the lower portion of the vacuum cleaner.
FIG. 14 is a front view of a lower portion of the vacuum cleaner.
FIG. 15 is an enlarged view of a side section of the lower portion of the vacuum cleaner.

FIG. 9 shows the position of the wheel vacuum cleaner according to one embodiment of the present invention. The wheel(s) 6 will only function when the vacuum cleaner is not operating or energized. The idle vacuum cleaner will be resting on the wheel(s) 6 and can be pushed about. When the vacuum cleaner is functioning or energized, the hovering effect will lift the vacuum cleaner up together with the wheel (s) 6 rendering it wheel-less. The cleaner is suspended on a cushion of air and the wheels 6 are not touching the ground/floor.

FIG. 9 also shows air return holes 7 on the underside of the casing for a portion of the entrapped air to return to the exhaust chamber for cooling the exhaust chamber of the vacuum cleaner where the electrical cable are stored. The air return holes 7 are further fitted with filtering means to filter the dust resulting from the hovering action of the vacuum cleaner.

FIGS. 10-15 show a curvature of edges of a base plate of the vacuum cleaner. These angles control the flow of the air from the bottom of the base. If the angle is higher, the air flow from under the base will flow more sideways than upwards. This will control the air from blowing sideways only and will blow away dust on the floor or carpets. In certain embodiments the angle is between 0° and 90°. In other embodiments, the angle is between about 30° and about 70°.

Figure 16:
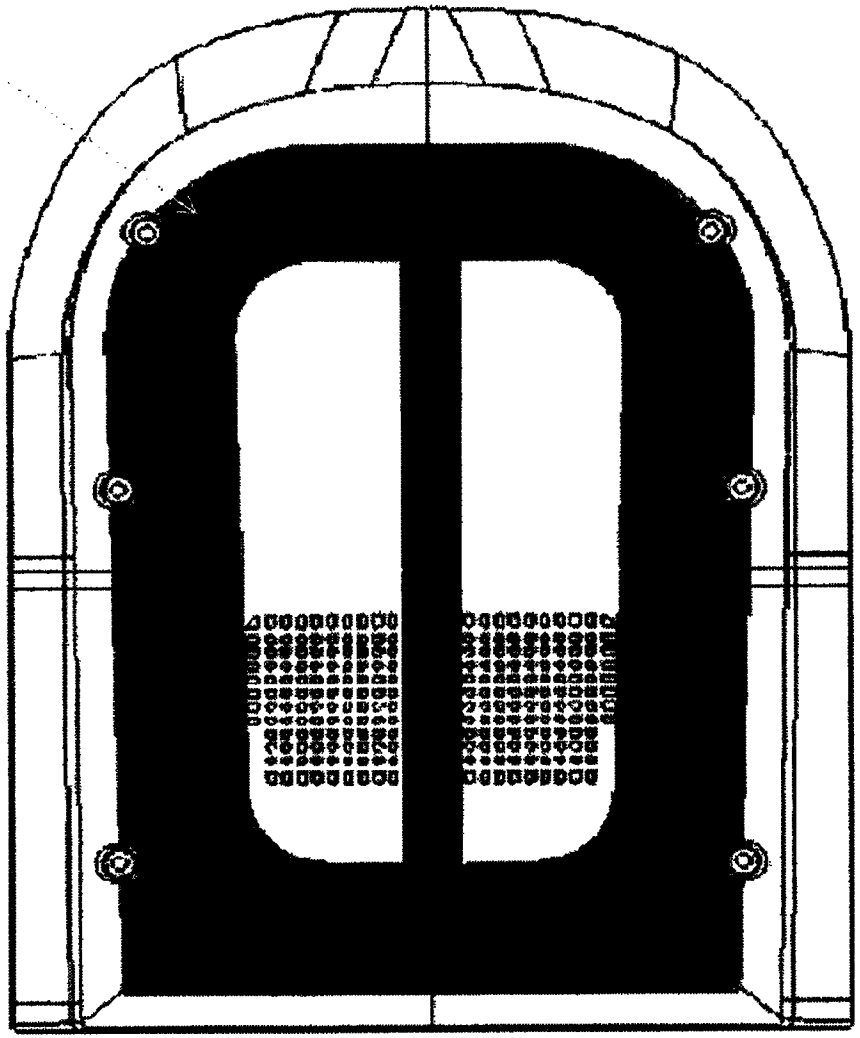
FIG. 16 is a lower view of the vacuum cleaner with a portion of an enclosed region outside of the air outlet region highlighted.
Figure 17:
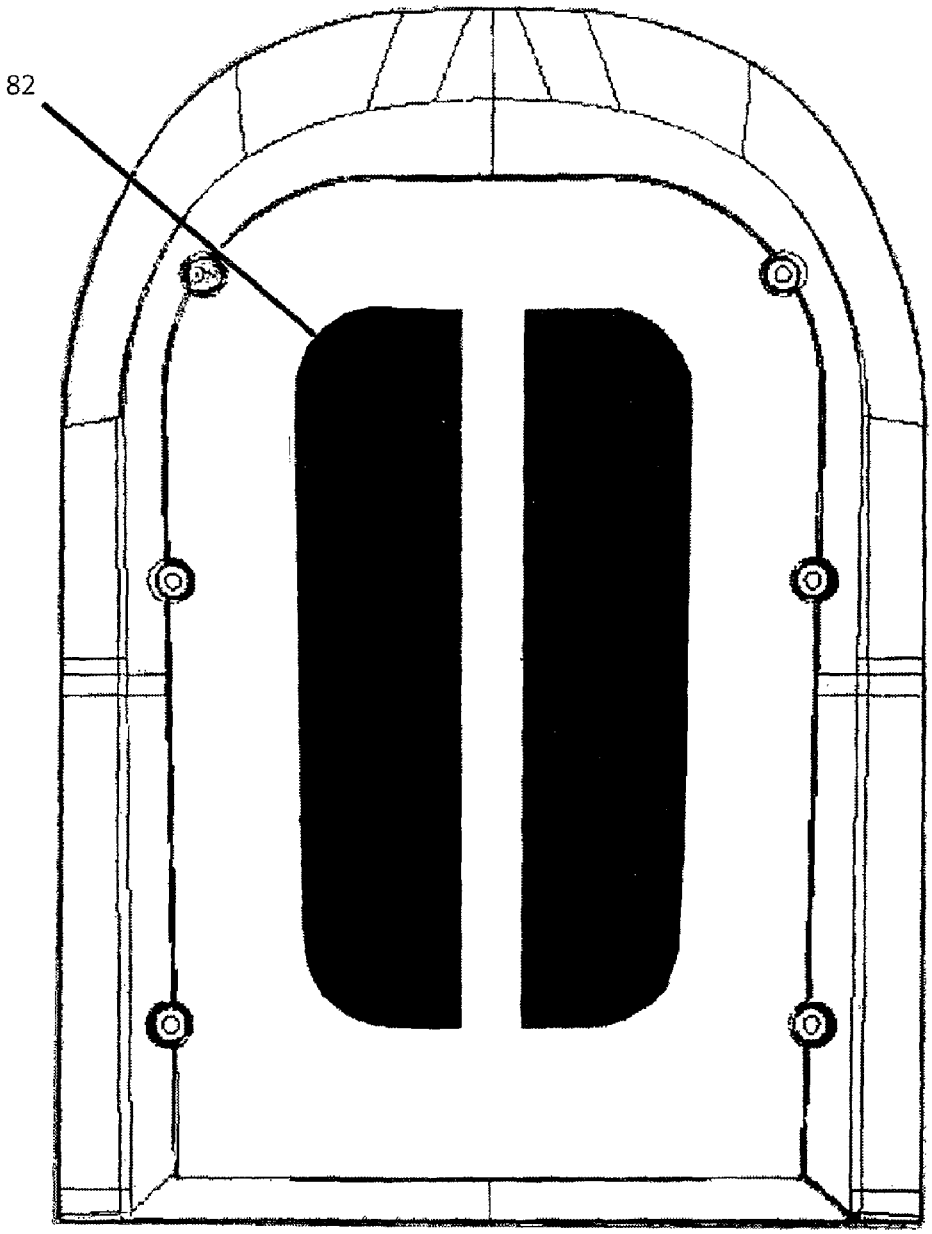
FIG. 17 is a lower view of the vacuum cleaner with the air outlet region highlighted.

Yet another aspect of the invention relates to the relative areas beneath the vacuum cleaner, as illustrated in FIGS. 16-20. In FIG. 16, an area of the underside outside of air outlet regions 80 is highlighted. In certain embodiments, this highlighted area is about 244.3 square centimeters. In FIG. 17, the air outlet regions 82 are highlighted. In certain embodiments, this highlighted area is about 146.7 square centimeters.

Figure 18:
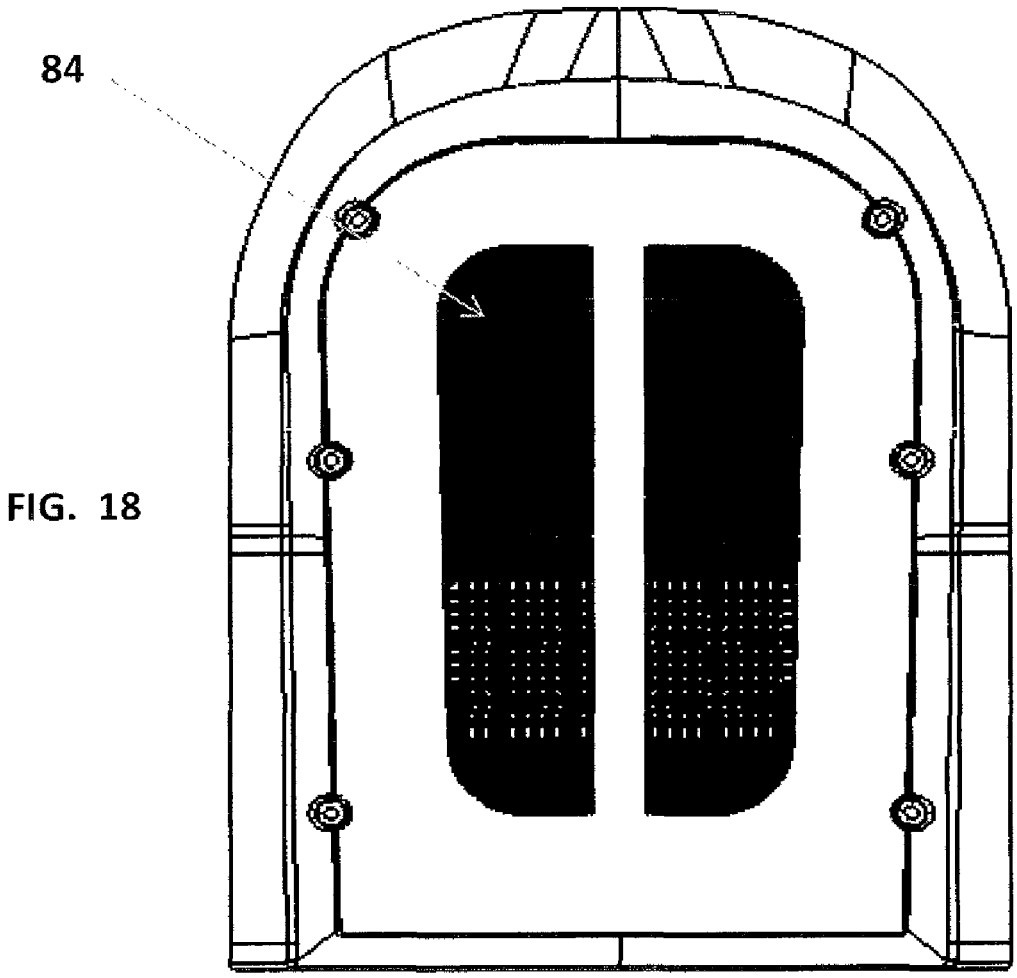
FIG. 18 is a lower view of the vacuum cleaner with a with the air outlet region highlighted except for the air outlets.
Figure 19:
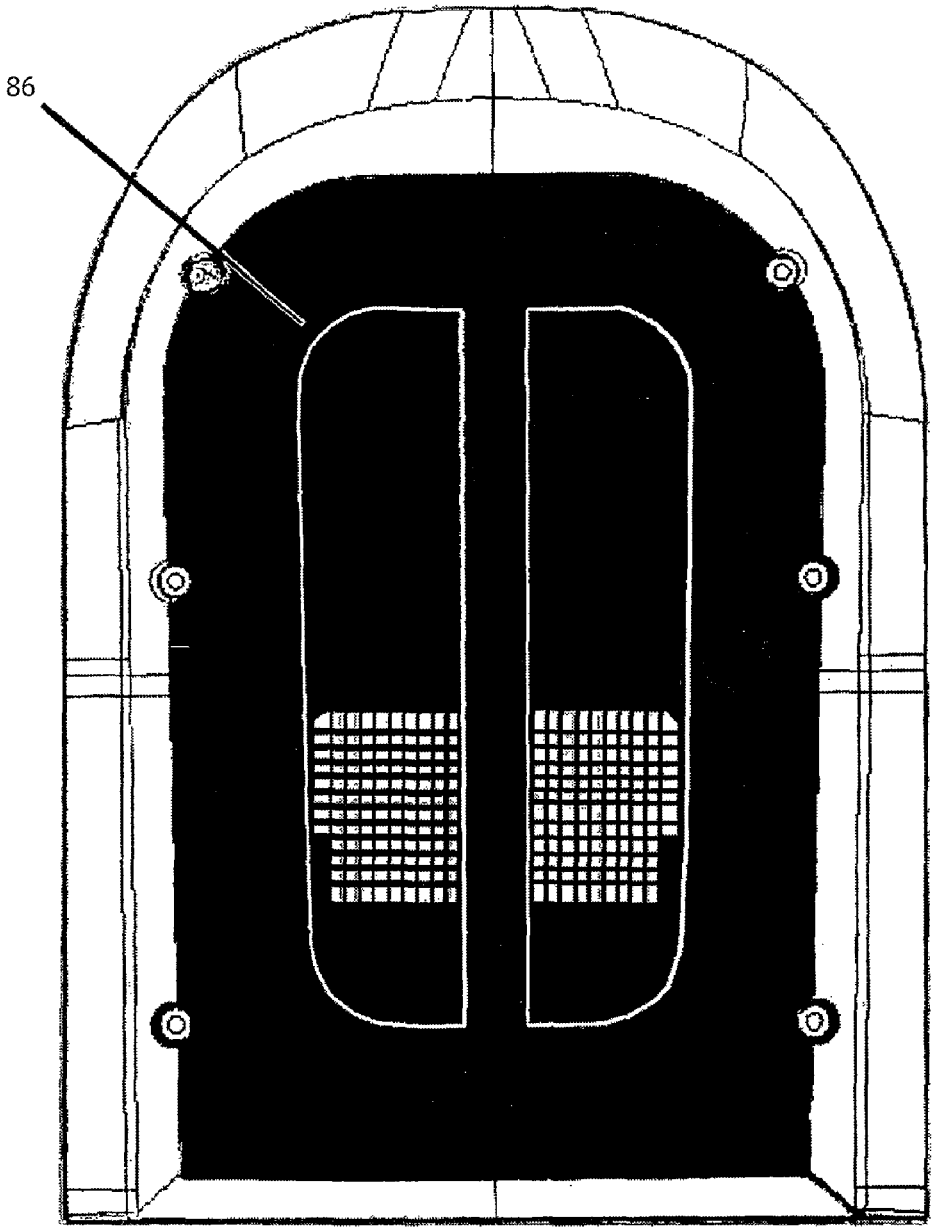
FIG. 19 is a lower view of the vacuum cleaner with the enclosed region highlighted except for the air outlets.

In FIG. 18, the air outlet regions except for the air outlets 84 is highlighted. In certain embodiments, this highlighted area is about 135.2 square centimeters. In FIG. 19, the underside except for the air outlets 86 is highlighted. In certain embodiments, this highlighted area is about 379.5 square centimeters.

The total hole area is calculated by subtracting the area highlights in FIG. 17 from the area highlighted in FIG. 18. In certain embodiments, the hole area is about 11.5 square centimeters. The percentage of the air outlet regions to the total area may be calculated by dividing the air outlet region highlighted in FIG. 17 by the total area highlighted in FIG. 19. In certain embodiments this percentage is about 38 percent. To maintain good hovering performance, this percentage should be between 30 and 50 percent.

The percentage of the hole area may be calculated by dividing the hole area by the total area highlighted in FIG. 19. In certain embodiments this percentage is about 3.03 percent. To maintain good hovering performance, this percentage should be between about 2 and 10 percent.

Figure 20:
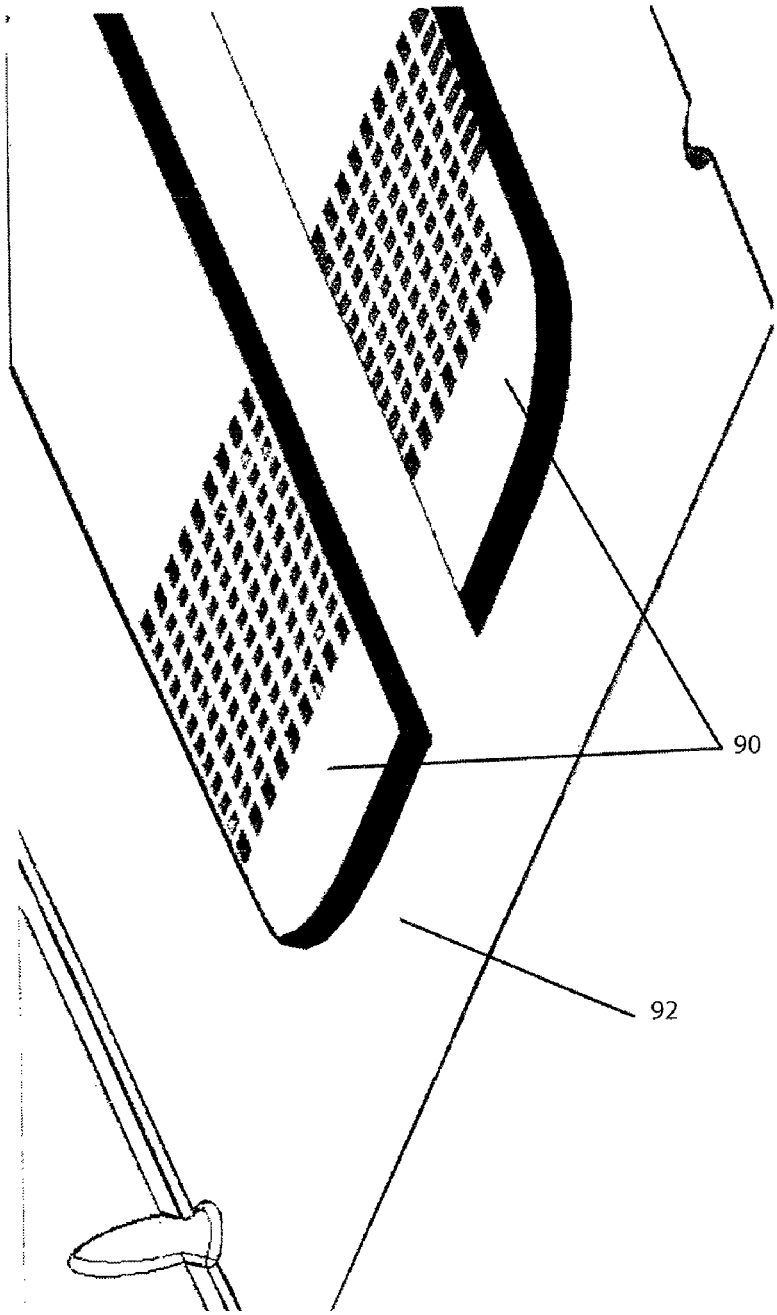
FIG. 20 is a lower view of the vacuum cleaner showing a depth of the air outlet region.

FIG. 20 illustrates the depth of the air outlet regions 90 compared to the other portions 92 on the lower side of the vacuum cleaner. This depth should be between about 2 and 10 millimeters. In certain embodiments, the depth is about 4.5 millimeters. Using such a depth enables the vacuum cleaner to exhibit good hovering performance.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

The invention claimed is:

1. A hovering vacuum cleaner comprising:

a suction inlet;

a filter in a filter chamber;

a casing enclosing the filter chamber;

an impelling motor;

a shell shaped structure enclosing the impelling motor;

air outlets predisposed symmetrically at both sides of an underside of the casing, wherein the shell shaped structure covers the air outlets at both sides of the casing;

a pathway for air to flow from the inlet through the dust filter, the impelling motor and emit through the air outlet; and a skirting predisposed along the perimeter of the underside of the casing to entrap air emitted through the air outlet and to create a cushion of air at a bottom of the casing to have a hovering effect, wherein the underside of the casing where the air outlets are predisposed has an inwardly and upwardly angled surface predisposed symmetrically along a longitudinal axis of the underside of the casing to increase air retention and enhance the hovering effect.

2. The hovering vacuum cleaner according to claim 1, and further comprising forward and backward directional vanes installed at the air outlets at predetermined angles to direct air flow emitted through the outlet to the front and back directions of the vacuum cleaner.

3. The hovering vacuum cleaner according to claim 1, and further comprising air distribution channels which are predisposed symmetrically on both sides of the underside of the casing along the longitudinal axis of the underside of the casing, wherein the air distribution channels are in communication with the air outlets for directing more air to the front and back directions of the vacuum cleaner.

4. The hovering vacuum cleaner according to claim 2, and further comprising air distribution channels that are predisposed symmetrically on both sides of the underside of the casing along the longitudinal axis of the underside of the casing.

5. The hovering vacuum cleaner according to claim 4, and further comprising a jet outlet predisposed at the back of vacuum cleaner enabling the entrapped air to flow through for self-propelling the vacuum cleaner for ease of maneuvering by the user when the vacuum cleaner is energized.

6. The hovering vacuum cleaner according to claim 5, wherein the jet outlet can be partially or fully closed by a jet outlet lid.

7. The hovering vacuum cleaner according to claim 1, and further comprising at least one wheel for maneuvering by the user when the vacuum cleaner is not energized.

8. The hovering vacuum cleaner according to claim 1, and further comprising a shell shaped structure covering the impelling motor and in communication with the air outlets for directing the air flow emitted from the impelling motor to the bottom of the vacuum cleaner through the air outlet.

9. The hovering vacuum cleaner according to claim 1, and further comprising air return holes on the underside of the casing for portion of the entrapped air to return to the exhaust chamber for cooling down the vacuum cleaner.

10. The hovering vacuum cleaner according to claim 3, and further comprising air distribution channels that are predisposed symmetrically on both sides of the underside of the casing along the longitudinal axis of the underside of the casing.

11. The hovering vacuum cleaner according to claim 10, and further comprising a jet outlet predisposed at the back of vacuum cleaner enabling the entrapped air to flow through for self-propelling the vacuum cleaner for ease of maneuvering by the user when the vacuum cleaner is energized.

12. The hovering vacuum cleaner according to claim 11, wherein the jet outlet can be partially or fully closed by a jet outlet lid.

13. The hovering vacuum cleaner according to claim 12, and further comprising at least one wheel for maneuvering by the user when the vacuum cleaner is not energized.

14. The hovering vacuum cleaner according to claim 13, and further comprising a shell shaped structure covering the impelling motor and in communication with the air outlets for directing the air flow emitted from the impelling motor to the bottom of the vacuum cleaner through the air outlet.

15. The hovering vacuum cleaner according to claim 14, and further comprising air return holes on the underside of the casing for a portion of the entrapped air to return o the exhaust chamber for cooling down the vacuum cleaner.

16. The hovering vacuum cleaner according to claim 1, and further comprising a jet outlet predisposed at the back of vacuum cleaner enabling the entrapped air to flow through for self-propelling the vacuum cleaner for ease of maneuvering by the user when the vacuum cleaner is energized.

17. The hovering vacuum cleaner according to claim 16 ,wherein the jet outlet can be partially or fully closed by a jet outlet lid.

18. The hovering vacuum cleaner according to claim 1, wherein the air outlets extend through the inwardly and upwardly angled surface.

* * * * *